US010299525B1

(12) United States Patent
Buckman

(10) Patent No.: US 10,299,525 B1
(45) Date of Patent: May 28, 2019

(54) PERSONAL HEATING AND COOLING DEVICE

(71) Applicant: Michael Buckman, Plains, MT (US)

(72) Inventor: Michael Buckman, Plains, MT (US)

( * ) Notice: Subject to any disclaimer, the term of this patent is extended or adjusted under 35 U.S.C. 154(b) by 9 days.

(21) Appl. No.: 15/698,111

(22) Filed: Sep. 7, 2017

Related U.S. Application Data

(63) Continuation-in-part of application No. 14/957,237, filed on Dec. 2, 2015.

(60) Provisional application No. 62/086,588, filed on Dec. 2, 2014.

(51) Int. Cl.
*A42B 1/00* (2006.01)
*F25B 21/02* (2006.01)
*A42B 3/28* (2006.01)

(52) U.S. Cl.
CPC ..... *A42B 1/008* (2013.01); *A42B 3/286* (2013.01); *F25B 21/02* (2013.01)

(58) Field of Classification Search
CPC ..... F25B 21/02; F25B 2321/02; F25B 2321/021; F25B 2321/0211; F25B 2321/025; A42B 1/008; A42B 3/286
USPC ..... 62/3.1, 3.2, 3.5
See application file for complete search history.

(56) References Cited

U.S. PATENT DOCUMENTS 3,736,927 A 6/1973 Misaqi
4,483,021 A * 11/1984 McCall ..... A42B 3/285 2/7
5,146,757 A 9/1992 Dearing
5,193,347 A 3/1993 Apisdorf
5,655,374 A * 8/1997 Santilli ..... A41D 13/1218 2/905
RE36,242 E 6/1999 Apisdorf
6,125,636 A 10/2000 Taylor et al.
6,438,964 B1 8/2002 Giblin
6,571,574 B1 6/2003 Blackstone
6,715,309 B1 4/2004 Junkins
6,823,678 B1 11/2004 Li
6,915,641 B2 7/2005 Harvie
7,143,451 B2 12/2006 Lundgren
7,571,615 B1 * 8/2009 Bikes ..... A42B 3/285 62/259.3
8,397,517 B2 3/2013 Monk
8,397,518 B1 3/2013 Vistakula
8,602,855 B2 12/2013 Turner
9,175,887 B2 * 11/2015 Lau ..... F25B 21/02
2005/0193742 A1 * 9/2005 Arnold ..... A41D 13/005 62/3.5
2006/0101556 A1 * 5/2006 Goldsborough ..... A42B 3/285 2/171.3
2007/0137685 A1 * 6/2007 Jwo ..... A42B 3/285 136/203
2008/0155991 A1 * 7/2008 Lee ..... A42B 3/285 62/3.2

(Continued)

*Primary Examiner* — Marc E Norman

(57) ABSTRACT

Air from a heating or cooling unit stored in a backpack is blown by a fan into an extendable tube and through a delivery tube to deliver heated or cooled air to wearer. The delivery tube can be run into a hat, helmet, or cap to heat or cool the head of the wearer. Alternatively, the delivery tube can bifurcate to create a yoke from which two perforated delivery tubes extend that run over the shoulders of the wearer beneath their clothes to deliver heated or cooled air. The extendable tube allows the wearer to move freely, turning their head side to side or nodding up and down.

7 Claims, 9 Drawing Sheets

(56) References Cited

U.S. PATENT DOCUMENTS

| | | | | |
|---|---|---|---|---|
| 2008/0306433 | A1 | 12/2008 | Cesaroni | |
| 2009/0044932 | A1 | 2/2009 | Blackstone | |
| 2010/0005572 | A1 | 1/2010 | Chaplin | |
| 2010/0198322 | A1* | 8/2010 | Joseph | A61F 7/007 607/108 |
| 2010/0236267 | A1 | 9/2010 | Korytnikov | |
| 2011/0078845 | A1* | 4/2011 | McKinney | A42B 3/285 2/422 |
| 2011/0219506 | A1* | 9/2011 | Uttrachi | A61F 9/067 2/8.6 |
| 2011/0231977 | A1 | 9/2011 | Rupnick et al. | |
| 2012/0227432 | A1 | 9/2012 | Creech et al. | |
| 2018/0064199 | A1* | 3/2018 | Battis | A42B 3/286 |
| 2018/0094838 | A1* | 4/2018 | Ichiki | F25B 21/02 |

* cited by examiner

PERSONAL HEATING AND COOLING DEVICE

CROSS-REFERENCE TO RELATED APPLICATIONS

This application is a continuation-in-part of co-pending U.S. patent application Ser. No. 14/957,237 filed Dec. 2, 2015, which claims the benefits of U.S. Provisional Application No. 62/086,588, filed Dec. 2, 2014, the disclosures of which are hereby incorporated by reference in their entirety including all figures, tables, and drawings.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

The need for personal heating and cooling devices is apparent. Everyone empathizes with a highway construction worker as they drive by on a 90+ degree day. Personalized heating and cooling is also necessary for those who are unable to regulate their body temperature. The elderly or invalids may have trouble keeping warm due to frailty, limited activity, or medication. A poor or inconsistent power grid may also prevent a person from being able to survive comfortably in their surrounding (see Kuchofuku's air-conditioned bed and clothing line).

There are many devices that have been designed to provide an individual personal heating and cooling options (U.S. Pat. No. 3,736,927; RE 36,242; U.S. Pat. Nos. 6,125,636; 6,823,678; 6,915,641; and 8,602,855, and U.S. Patent Application Publication No. 2008/0306433). Many of these devices have been included in garments and are portable. Heating and cooling options in some of these devices use caustic chemicals or emit noxious fumes. Further, many are unobtainable by the average worker because of their expense or impractical because of their limited operating time.

A need remains for an affordable, long lasting personal heating and cooling device. The device should be simple and practical for use by the average person.

All patents, patent applications, provisional patent applications and publications referred to or cited herein, are incorporated by reference in their entirety to the extent they are not inconsistent with the teachings of the specification.

BRIEF SUMMARY OF THE INVENTION

The invention involves a personal heating and cooling device that can be carried in a backpack or fanny pack. Air conditioning units that heat and/or cool are equipped with fans to move heated or cooled air through a perforated tube to deliver it to the wearer. An extendable transfer tube between the fan and delivery tube allows the user to move freely wearing the device.

A heating device can be a simple element warmed by electrical current. Preferably, components for the device can sustain up to 12 hours of continuous use. Cooling units can be mini, battery operated refrigerators or elements isolated from the mini refrigerators. An alternative cooling unit consists of ice packs, blue ice packs, or water beads wrapped in a snap rag lying atop sponges. Frozen water laden sponges wrapped in snap rags also are effective cooling units. This cooling unit for the subject device is inexpensive and easy to maintain. Cooling and heating units are contained in an insulated housing to hold temperature. It is anticipated that heating and cooling units will be specifically constructed for use in the subject device, it is only necessary that they are lightweight and draw little energy so they provide comfort for the worker throughout the work day. An on/of switch and fan velocity controller can be placed on the outside of a garment fitted with the device so control is readily accessible to the wearer.

Another effective personal cooling unit has a self-cooled Peltier module as its source of cool air. An ice pack covers the cold side of the module. Air is drawn from the ice pack to cool the user. In a particularly preferred embodiment, a portion of the cooled air is directed back to partially cool the hot side of the module. The cool air can be directed at the hot side of the module or the cool air can cool the air being drawn in that will eventually contact the module. An additional fan or blower in the unit directed at the hot side of the module further optimizes cooling. The cooling unit configured in this manner prolongs the cooling effect provided to the user.

DETAILED DESCRIPTION OF THE INVENTION

Figure 1:
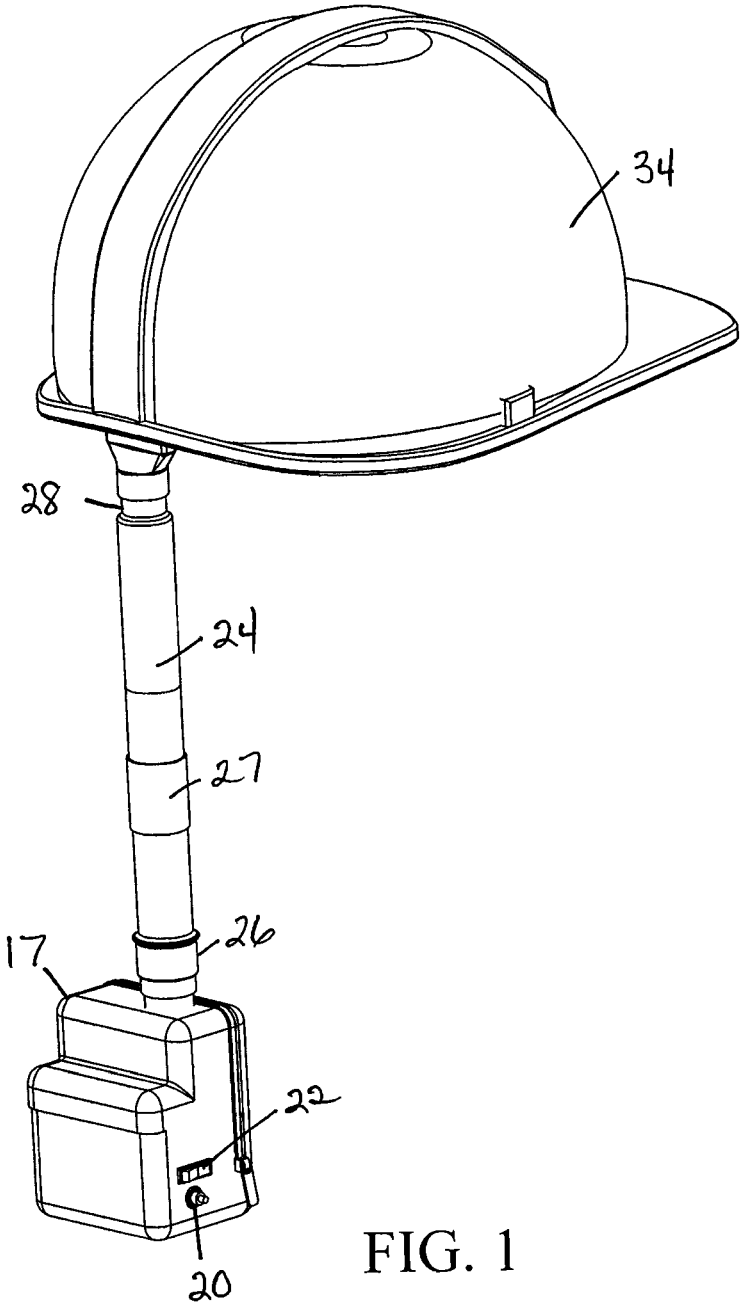
FIG. 1 is a right side rear perspective view of a preferred embodiment of the personal heating and cooling device of the subject invention.
Figure 2:
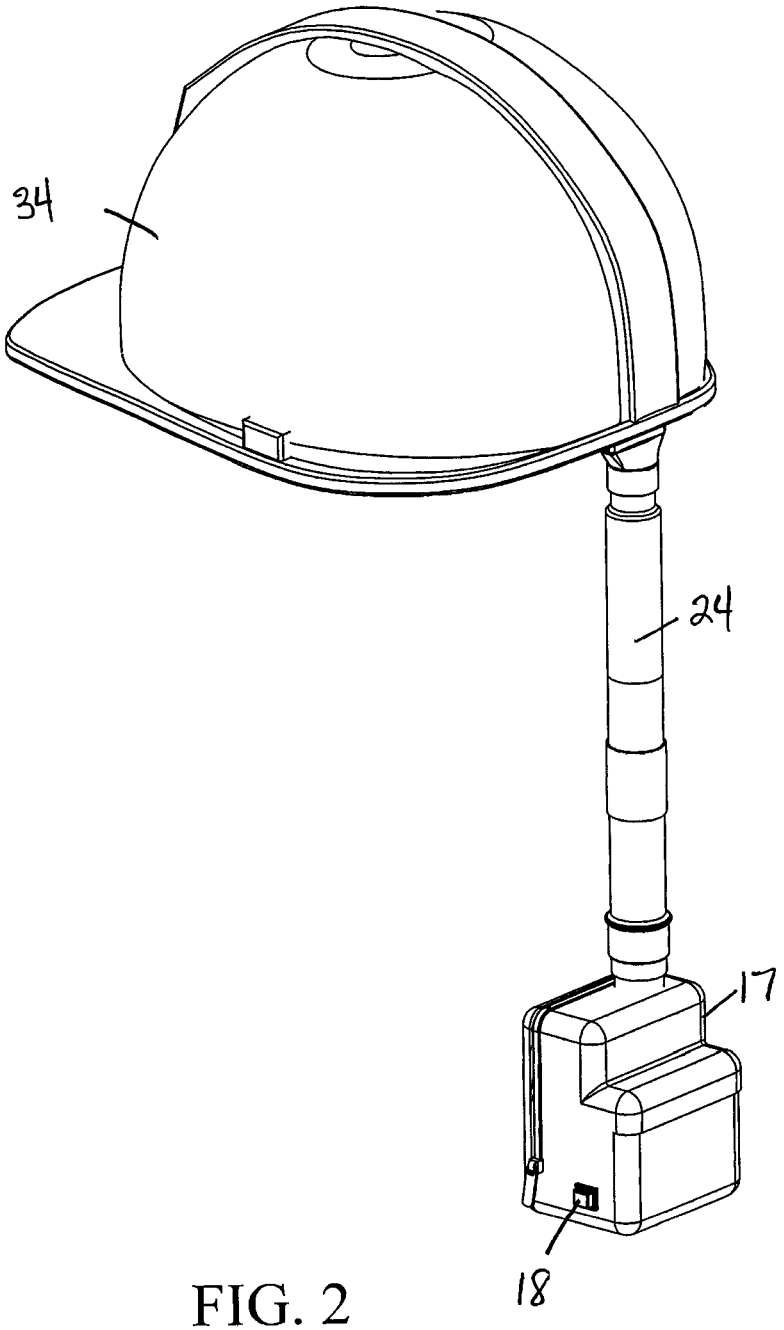
FIG. 2 is a left side rear perspective view of the preferred embodiment of the personal heating and cooling device shown in FIG. 1.
Figure 3:
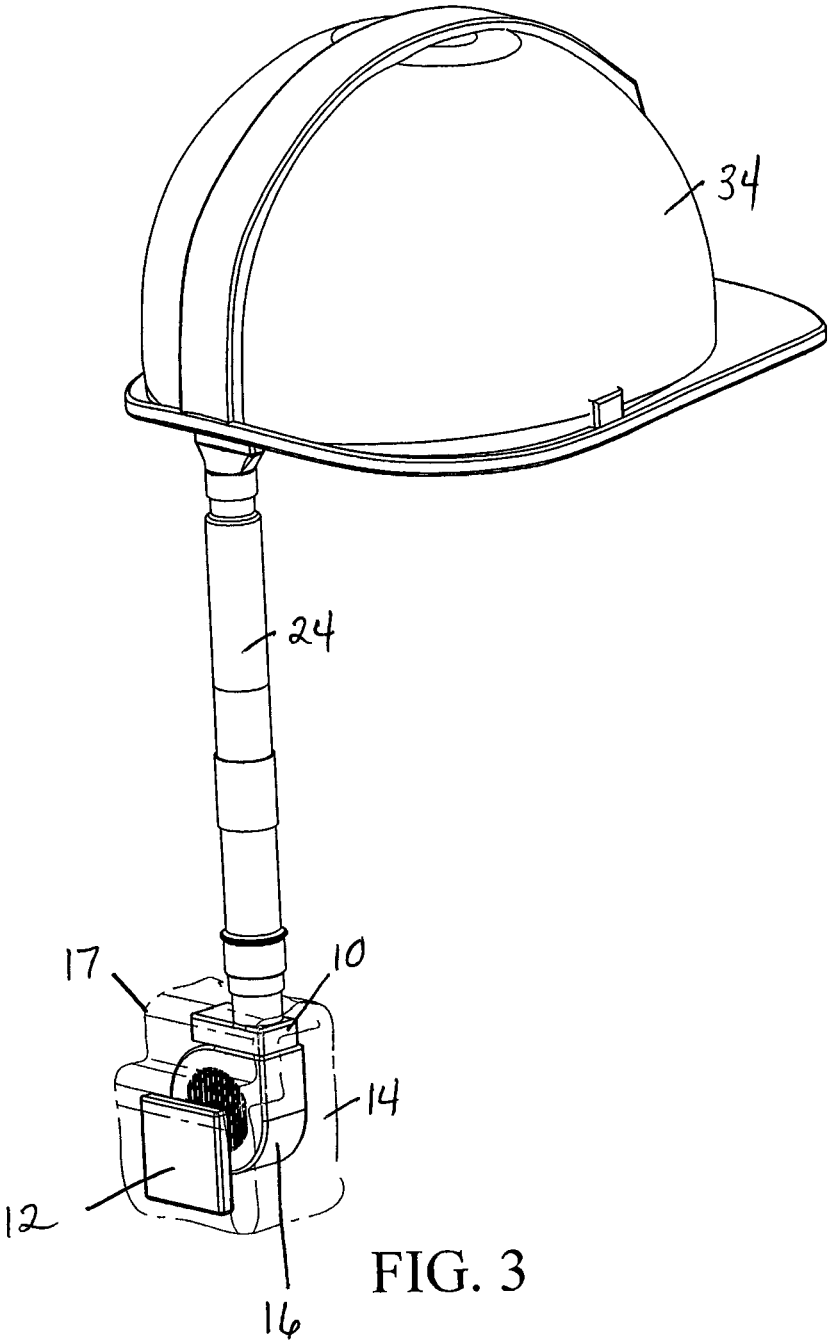
FIG. 3 is a right side rear perspective view of the preferred embodiment of the personal heating and cooling device shown in FIG. 1 showing the fan and heating/cooling element.
Figure 4:
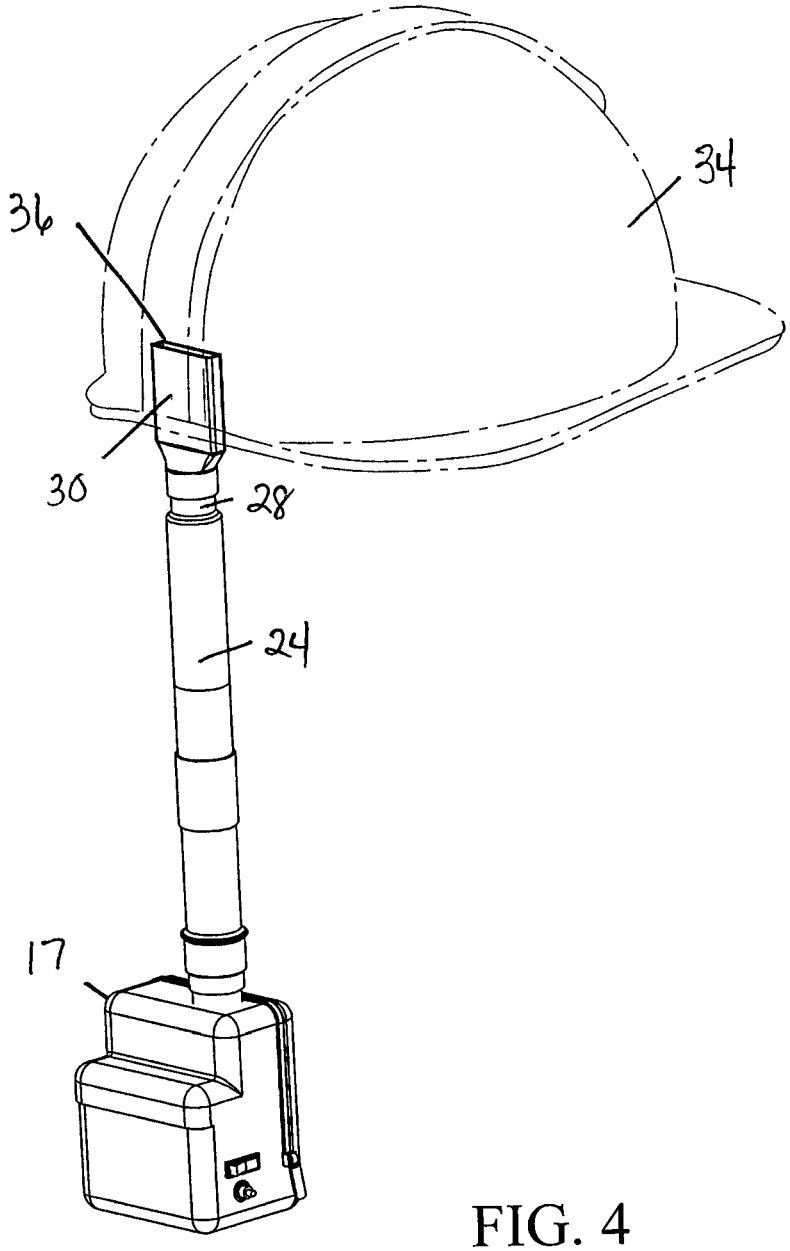
FIG. 4 is a right side rear perspective view of the preferred embodiment of the personal heating and cooling device shown in FIG. 1 showing the disbursement means inside a helmet.
Figure 5A:
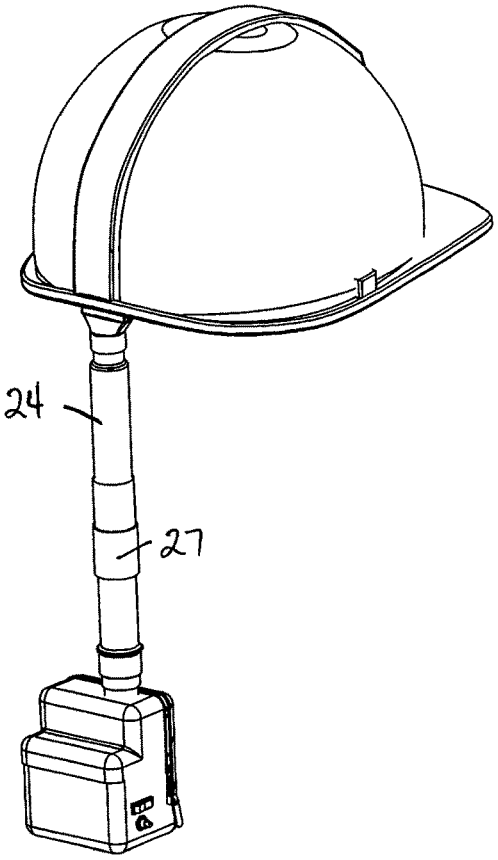
FIG. 5A is a right side rear perspective view of the preferred embodiment of the personal heating and cooling device shown in FIG. 1 showing the extendable tube.
Figure 5B:
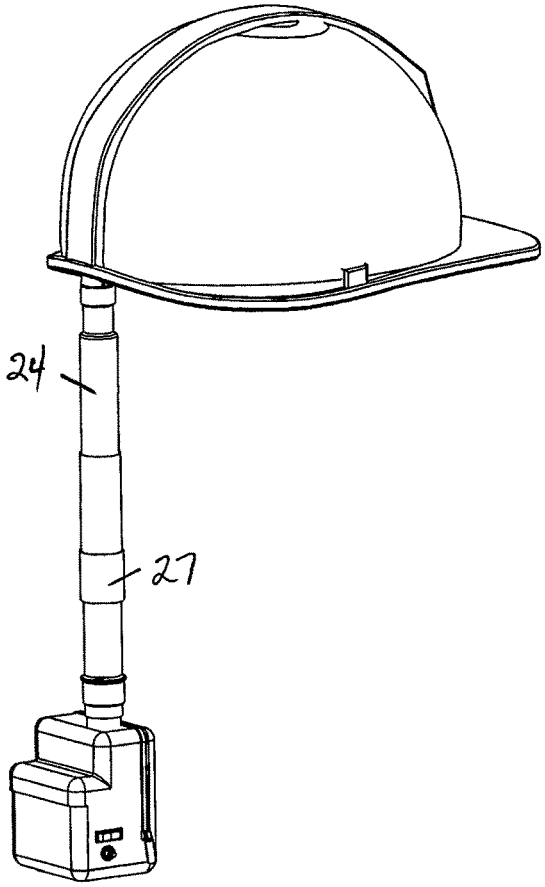
FIG. 5B is a right side rear perspective view of the preferred embodiment of the personal heating and cooling device shown in FIG. 5A showing the extendable tube extended and twisted.
Figure 6:
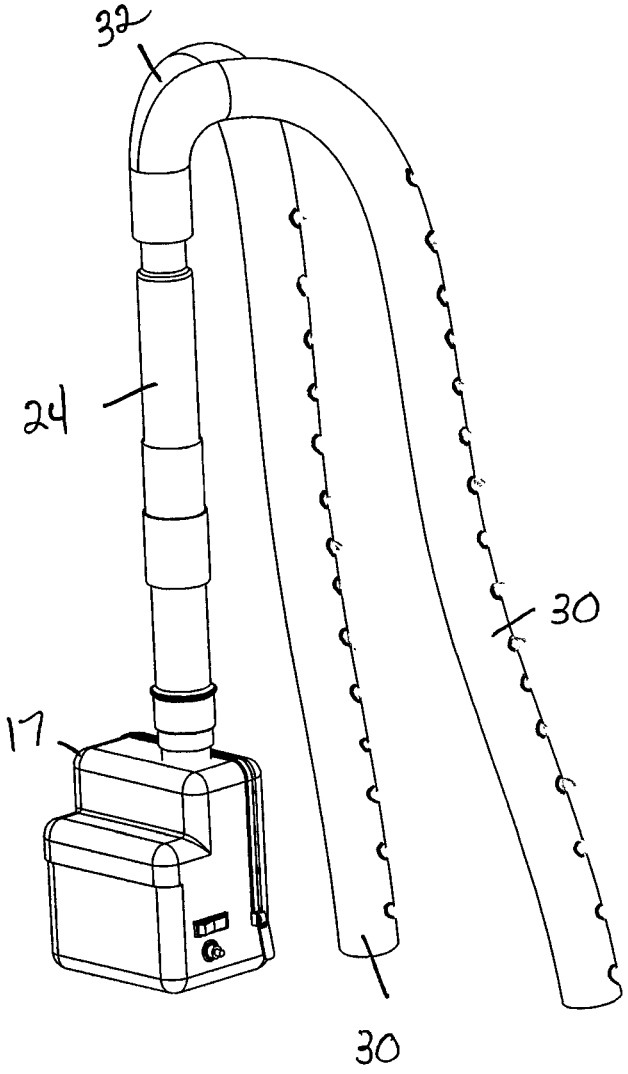
FIG. 6 is a right side rear perspective view of another preferred embodiment of the personal heating and cooling device of the subject invention.

The invention involves a personal heating and cooling device. Heating and cooling air conditioning units are conveniently carried in a backpack. Heated or cooled air from the heating and cooling units travels through an extendable transfer tube to a delivery tube for delivery to the wearer.

The air conditioning units 10 of the device of the subject invention can be heating units to heat the air and user, cooling units to cool the air and user, or can contain both heating and cooling units. The heating and cooling units are small and can be conveniently carried by the user in a backpack or fanny pack. In a preferred embodiment, the heating units are elements heated by a battery. One skilled in the art will be able to identify the appropriate size of element, wattage, and the battery needed to drive the element. It is only necessary that the element provide sufficient heat to warm the user of the subject device. It is also important that the element not be so large as to overheat causing a danger of melting the enclosure or burning the skin and clothes of the wearer. The element should be properly insulated with heat resistant materials. In an exemplified embodiment, elements used were 20 to 150 watts. A battery operated heat source will sustain a constant and consistent heat during the duration of use unlike chemical heat packs.

In one preferred embodiment, the cooling unit is a battery operated insulin refrigerator like those available from Zhengzhou Dison Electric Co, Ltd., China. These refrigerators can be used alone or in tandem to provide sufficient cooling. When two battery operated mini refrigerators are used together the doors are removed from each refrigerator unit and the units are connected together. An air intake is positioned at the bottom of the connection and the fan and non-perforated extendable tube are placed opposite the intake at the air outlet. A plastic fitting could be molded to place the refrigeration units in position and provide the air intake and outlet. Another preferred cooling unit uses a cool snap rag and a band of water beads (Cool-offs.com). The rag once snapped to activate the crystals will stay cool as long as it stays wet (ENDURA COOL®, Mission Athlete Care, New York, N.Y.). Alternatively, water laden frozen sponges can be wrapped in a snap rag. Melting water from the sponges or condensation from the beads insure the rag stays wet. The wrapped rag placed on frozen or unfrozen sponges prevent melted water from escaping the system. Cooled air is pulled by the fan from the insulated cooler through the extendable transfer tube.

The personal heating and cooling device of the subject invention can contain a heating unit, a cooling unit, or both. A thermoelectric module provides both heating and cooling with minimal power consumption. Each unit can be powered by a single battery 12 or each unit can have its own battery. Units can also be interchangeable. Both the heating and cooling units are enclosed in an insulated housing 14 to further regulate and maintain their temperatures. This container can be oversized so that a shelf or grid can be placed in the container separating the heating and/or cooling unit from any food or beverage item the user may wish to carry. The unit will cool or heat the item within the insulated container. The insulated container is ventilated to allow the fan 16 to pull heated or cooled air from the container and drive it through the system. It is noted however that the positioning of the fan 16 can vary with the type of air conditioning unit 10 used and the configuration of the housing and container. For example, in the embodiments shown in FIGS. 1-6 the fan 16 is positioned to push air through the conditioning unit 10. The fan however can also be positioned to draw air from, for example, the insulated housing. It is only necessary that the housing or containers be ventilated to allow the fan to draw and move air. Small industrial blowers are useful as the fans in the device of the subject invention and are powerful and inexpensive. For example, a 3200 rpm MagLev fan from Sunon (Brea, Calif.) is used in an exemplified embodiment.

While the heating and cooling units of the subject invention can be plugged in and run on alternating current, or powered by being plugged in to the cigarette lighter of a car, their use is most widely applicable when the heating and cooling units are powered by portable batteries. Anticipated uses include long days on the job flagging for highway construction during a 14 hour shift or on patrol in the deserts of Afghanistan. In these instances, the opportunity to recharge batteries is rare, thus batteries should be chosen that effectively power the system for the duration of anticipated use. One skilled in the art will recognize that the heating and cooling unit, as well as the fan, and battery size can all be coordinated to achieve maximum efficiency and run time.

In an exemplified embodiment, the personal heating and cooling device of the subject invention is contained in a backpack or fanny pack. This allows the user to conveniently carry the device and the container 17, i.e. a fanny pack, which collects the components of the device into a single unit. Pockets of the container can be used to store various components of the device. For example, the large center pocket of a fanny pack can contain the air conditioning units inside an insulated housing. The housing is ventilated to allow the fan to draw conditioned air from an outlet on the housing and push the air through the extendable tube. The battery driving the device can be placed in a separate outside pocket of the fanny pack so that the heat it generates does not interfere with the air conditioning device. In the drawings, the fan and air conditioning unit are disposed in the insulated housing 14 and the battery is contained in an adjacent compartment within the container 17.

In a particularly preferred embodiment, the personal heating and cooling devices of the subject invention are integrated into or contained within clothing. The units can be integrated into a jacket with the attached backpack or into a vest that has a back pocket. Further, the system can be incorporated into AC/DC full body suits. In all cases, including when the device is contained in a backpack or fanny pack container, controls can be wired to appear on the outside for convenient operation by the user. Controls can include a button or switch to turn the heating or cooling unit on or off 18. A knob or dial 20 can be provided to regulate the velocity of the fan pushing the conditioned air. Further, if the device contains both a heating and a cooling unit, or just a heating unit, a control switch can be provided to chose heating or cooling modes 22. Applicant notes that movement of unheated air by the fan of a unit containing only a heating unit could be a mode option for a user. The controls can be covered or concealed by a flap or be hidden in a pocket of a jacket or vest.

Heated or cooled air from the heating and cooling air conditioning units is pushed by the blower or fan 16 through the extendable transfer tube 24. The extendable tube should allow the user full movement while wearing the device. For example, in the exemplified embodiment, the extendable tube is a telescoping tube that has at least two sections. One end 26 of the telescoping transfer tube receives the heated or cooled air. The other end 28 of the telescoping transfer tube attaches to the delivery tubing 30 that delivers the conditioned air to the wearer. The telescoping sections allow the wearer to move freely when using the device. The junction 27 at which the sections telescope will swivel should the wearer twist or turn. Further, the junction telescopes so that should the wearer drop their head or shoulders the junction will lengthen and not pull or dislodge the perforated tube. One skilled in the art would be able to identify extendable tubing suitable for use in the subject invention that allows the user to stretch, twist, and move unencumbered and without losing the connection between the air conditioning units, fan, and the perforated tubing. For example, accordion-type tubing could provide such movement.

The conditioned air is delivered to the user through delivery tubing 30. The tubing should be flexible and durable to move with the user. In the exemplified embodiment tubing of about an inch in diameter is used. This tubing provided sufficient air flow to effectively heat or cool the user. In a particularly preferred embodiment, the tubing is flattened so it is more comfortable to the wearer.

The delivery tubing is connected to one end 28 of the extendable transfer tube 24. If the tubing is run into a hat or helmet 34 perforations may begin near the other end 28 of the extendable tube 24 so that heated and cooled air is run across the back of the wearer's neck. In the exemplified embodiment, the delivery tubing 30 is a flattened, flexible piece with an open end 36 that spills conditioned air effectively across the wearer's neck and directs the conditioned air toward the crown of the head. If the tubing is to be integrated into or run under clothing or a garment the delivery tubing can be perforated to deliver conditioned air evenly to the user. Parts of the delivery tube may be non-perforated until the tubing is inside the garment to prevent loss of the conditioned air. For example, the tube may bifurcate at a yoke 32 behind the shoulders and then two perforated tubes are run down along the torso. The tube could remain un-perforated before the yoke. Alternatively, the perforations prior to the yoke could direct conditioned air down the back of the wearer. Perforations in the tubing connected to the extendable transfer tube of the subject invention can be configured to receive the maximum effect from the conditioned air. Varying the configurations of the transfer tube and the delivery tube allow the device of the subject invention to be easily integrated or retro-fitted into headgear or garments.

In an alternative embodiment, the pack or container can carry an additional blower with a hose that can disburse smoke, dust, debris and fumes from the face of the wearer. The hose could be directed behind a face shield. Controls for the blower could be placed on the pack or clothing near those for the heating and cooling device. Disbursement and removal of such fumes could likewise be achieved by altering the perforations in the heating and cooling tubes to direct heated or cooled are to and around the face. Applying filters to the blower sources allows the quality of air supplied to the system and user to be controlled.

Figure 7A:
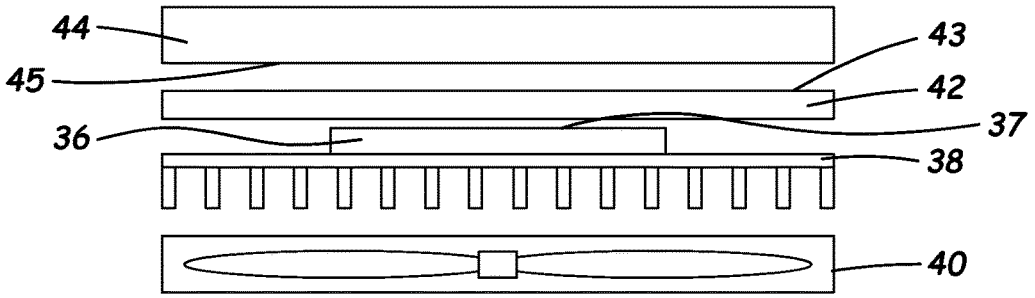
FIG. 7A is an exploded side view of a preferred cooling unit of the personal heating and cooling device of the subject invention.

A particularly effective cooling unit for a personal cooling device uses a self-cooled thermoelectric or Peltier module. Peltier modules have two sides that operate under the thermoelectric effect. Direct current applied to the module causes heat from one side of the module to move to the other side of the module leaving a module with a cold side and a hot side. The thermoelectric effect of the Peltier modules used in the personal cooling systems of the subject invention are optimized by supplementing the cooling effect of the module by adding a cooling element to the cold side cooling the module during operation. FIG. 7A shows a modified Peltier used as a cooling unit in a preferred embodiment of the subject invention. The Peltier module is shown at 36. Fins on the hot side of the module 36 serve as heat dissipating means 38 to disperse the heat generated by the module. Heat dissipating means 38 can include any heat conductive material in a configuration that increases the surface area to dissipate heat generated by the module's hot side. A small fan 40 can blow across the fins to dissipate the heat. A plate 42 of heat conductive material is applied to expand the surface area of the cold side of the module. In the exemplified embodiment, the fins and the cold plate are aluminum. Aluminum is lightweight not adding to the bulk of the overall device so that it can be comfortably carried by the user. Those skilled in the art would recognize however that there are other materials suitable for the construction of the fins 38 and cold plate 42 of the subject invention. An element that is cold, like an ice pack, directly contacts the cold plate. It is noted that the cold element 44 can directly contact the cold side of the module however modules are quite small to preserve battery life, adding the cold plate to the cold side increases the cold surface area and the cooling effect of the unit. Air is drawn from the cold element to cool the user. In a particularly preferred embodiment, a portion of that cooled air is also directed back to the Peltier element to cool the air contacting the hot side of the module.

Figure 7B:
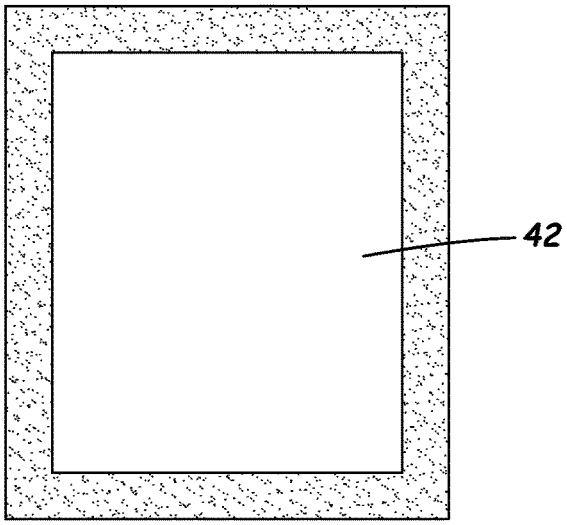
FIG. 7B is an top view of the cold plate of the cooling unit of the embodiment of the personal heating and cooling device shown in 7A.
Figure 7C:
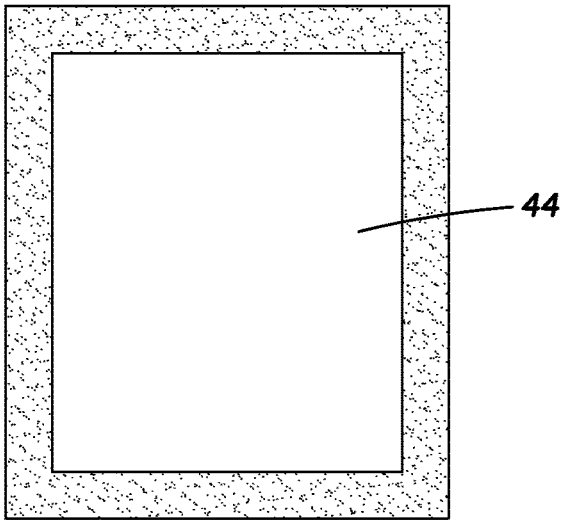
FIG. 7C is an top view of the cold element of the cooling unit of the embodiment of the personal heating and cooling device shown in 7A.
Figure 8:
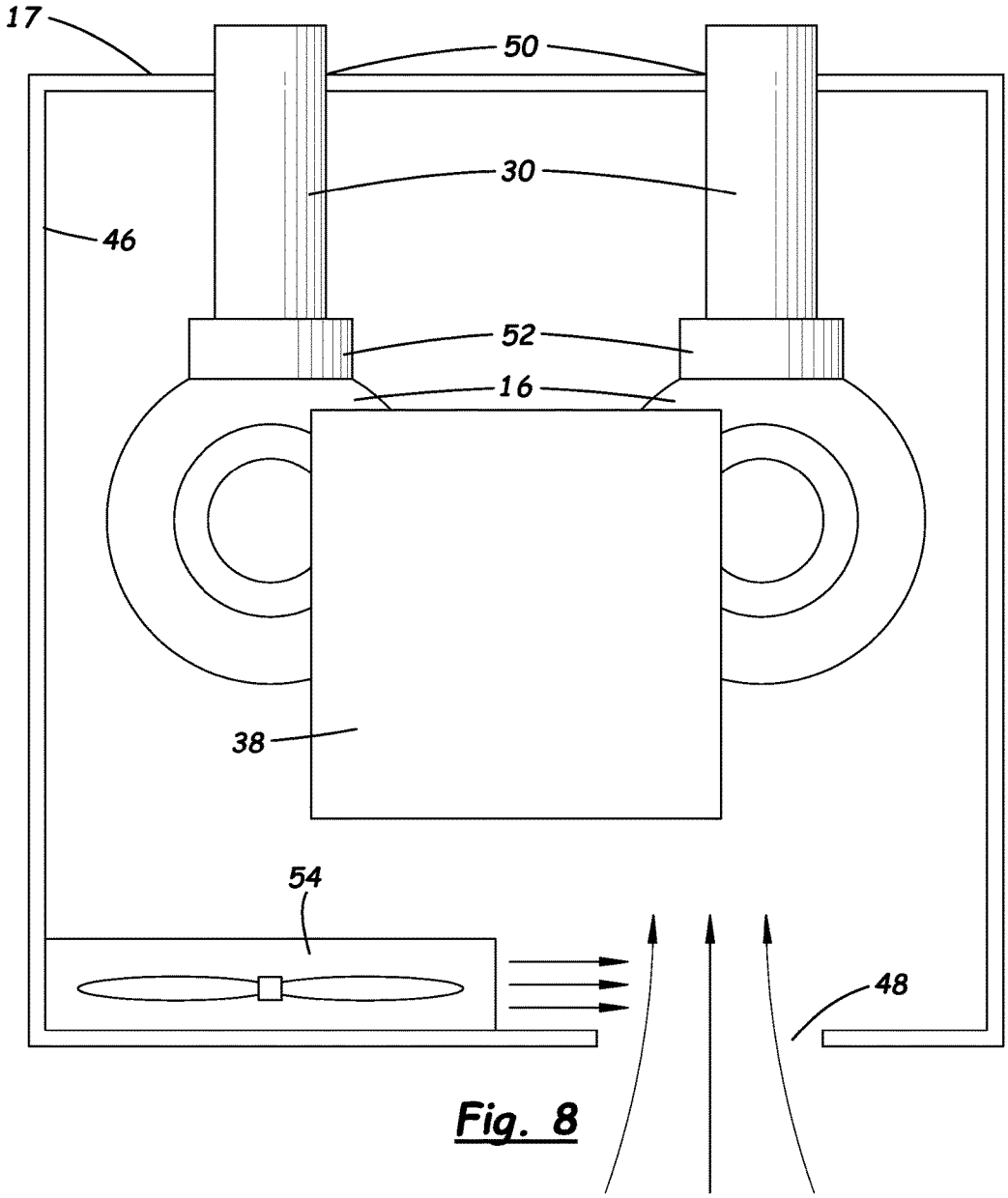
FIG. 8 is a cross-sectional view of another preferred embodiment of the personal cooling device of the subject invention.
Figure 9:
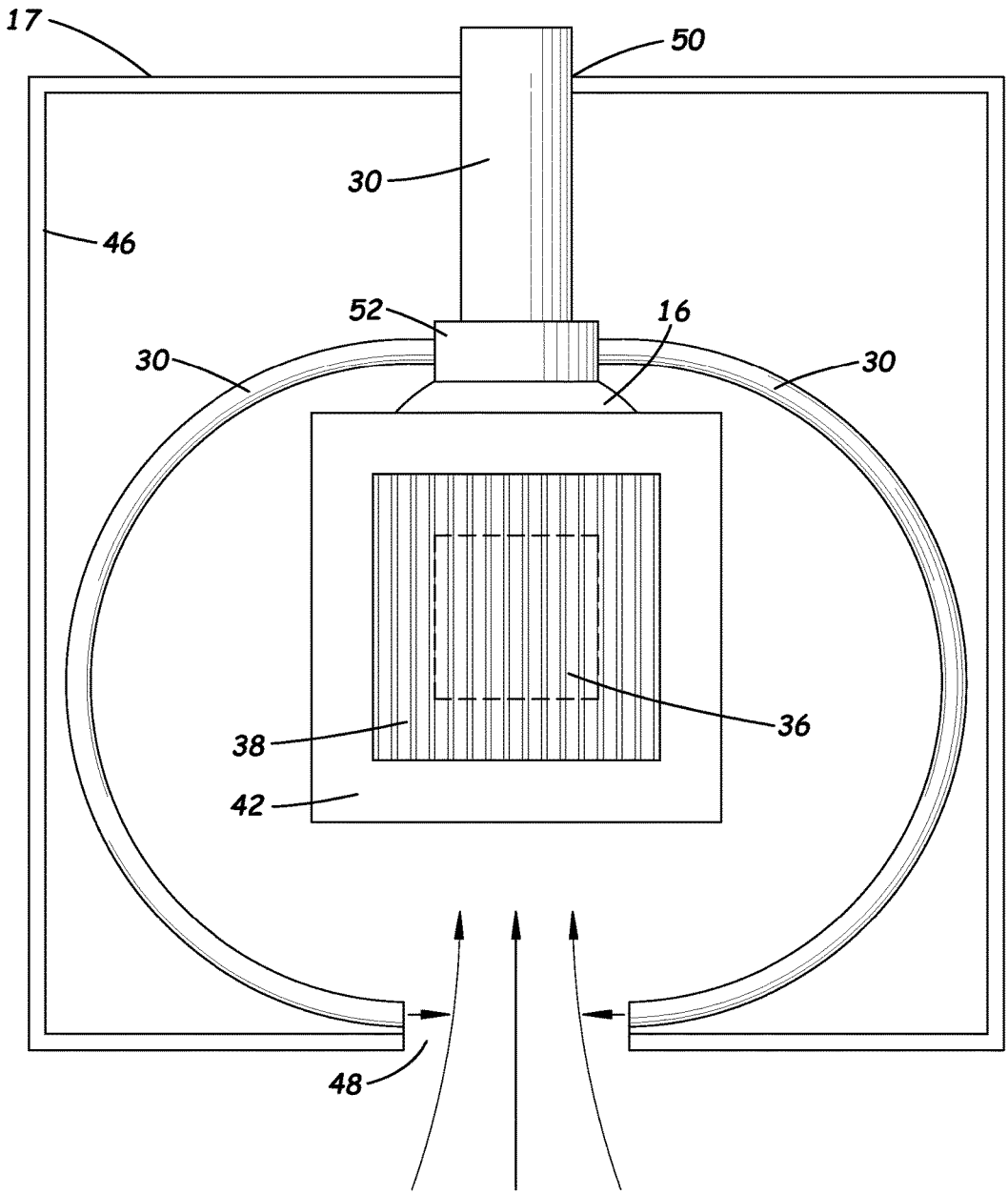
FIG. 9 is a cross-sectional view of another preferred embodiment of the personal cooling device of the subject invention.

Preferred configurations of the personal cooling devices of the subject invention are shown in FIGS. 8 and 9. Each cooling unit is enclosed in an insulated housing 17 the inside of which is shown at 46. The housing has an inlet 48 into which outside air is drawn and an outlet 50 through which cool air is distributed to the user. The cooling unit has a Peltier module 36 with heat dissipating means 38 on the hot side of the module. A heat conducting plate or cold plate 42 contacts the cold side of the Peltier module. A cold element 44 contacts the cold plate. Preferably, the cold plate and cold element are surrounded and enclosed to prevent them from contacting the air within the container. An airtight seal between a surface 45 of the cold element 44 and a surface of the cold side of the Peltier module 37 or a surface 43 of the cold plate 42 allows the cold element, such as an ice pack, to thaw and re-freeze repeatedly augmenting the cooling effect of the Peltier. FIGS. 7B and 7C show the cold plate 42 and the cold element 44 framed by hook and loop tape. Attaching these elements to each other with the hook and loop tape seals the edges of the elements blocking them from contacting the surrounding air. It would be apparent to one skilled in the art that there are other means by which the cold plate and cold element could be enclosed including, but not limited to, tape magnetic tape, gaskets, and molded containers. Blower 16 draws air from the cold element 44. The cooled air pulled from the blower is directed through the blower nozzle 52. The nozzle delivers the cooled air to the user through delivery means. In the exemplified embodiment, the cooled air is delivered to the user by being directed through the outlet 50 of the housing by delivery tubing 30. In a particularly preferred embodiment, the delivery tubing used to deliver cooled air to the user has rectangular openings allowing the cooled air to cool the wearer along the length of the tube. In the embodiments shown in FIGS. 8 and 9 the cooling effect of the cooling unit is further optimized by redirecting some of the cooled air to blow tangentially across the inlet 48 pre-cooling the air that will contact the Peltier. Cooled air is delivered near the inlet 48 by means that, in the exemplified embodiments, include, but are not limited to, a blower 54 or delivery tubing 30. The cool air moved by the blower 54 is released into the housing from the cold element 44 before it can exit through the outlet 50. Both means cool the air coming into the insulated housing that is eventually processed by the thermoelectric module increasing the efficiency and duration of cooling provided by the unit.

Augmenting the cooling effect of the Peltier module provides an energy efficient, effective cooling system. The cold plate expands the cold side surface area of the Peltier 36. Placing the cold element 44 on the cold plate cools the cold side making it more efficient. Cooling from the Peltier preserves the cold of the cold element 44. A cold element that is an ice pack thaws and re-freezes as the cooling system is operated. The efficiency of the system is further increased by cooling the air drawn into the insulated container that is applied to the Peltier. The disclosed cooling configuration maintains the cooling effect of the system even on the hottest days. An optional fan 40 blowing air on the fins helps dissipate heat from the hot side of the Peltier module 36. This fan can pull air from outside the unit or from within the unit for it is the motion of the air across the fins not the temperature of the air that dissipates the heat.

The heating and cooling units of the subject invention can be integrated into more permanent, or less portable units for inclusion on motorcycles or wheelchairs. Insulated boxes or cabinets have an air inlet and an air outlet to deliver conditioned air. The heat dissipating fins of the Petlier module can be left outside the cabinet or inside the cabinet.

Applicant anticipates that heating and cooling units will be specifically constructed for manufacture. The illustrated heating and cooling units are affordable and user friendly. It is important the manufactured units likewise maintain these qualities as well as be safe, compact, and energy efficient. The subject personal heating and cooling units provide individuals a lightweight, reliable option for comfort on the job. The subject device heats or cools the user instantly. The units are designed to move with the wearer using flexible perforated tubing and linked through the extendable transfer tube.

It is understood that the foregoing examples are merely illustrative of the present invention. Certain modifications of the articles and/or methods may be made and still achieve the objectives of the invention. Such modifications are contemplated as within the scope of the claimed invention.

The invention claimed is:

1. A personal cooling device comprising:

an insulated housing, the housing having at least one air inlet and at least one air outlet;

at least one air conditioning unit to cool air, the at least one air conditioning unit comprising, a Peltier module having a hot side and a cold side, heat dissipating means contacting the hot side of the Peltier module, and a cold element contacting the cold side of the Peltier module;

at least one blower disposed to move cooled air from the air conditioning unit; and a delivery tube configured to deliver a portion of the cooled air through the air outlet; and wherein said delivery tube is forked into a yoke outside the insulated housing.

2. The personal cooling device of claim 1, wherein said at least one air conditioning unit further includes a heat conductive plate contacting the cold side of the Peltier module.

3. The personal cooling device of claim 2, wherein a surface of said plate and a surface of said cold element are secured to form an air-tight seal between surfaces.

4. The personal cooling device of claim 1, wherein said at least one air conditioning unit is battery powered.

5. The personal cooling device of claim 1, further comprising a blower speed control switch.

6. The personal cooling device of claim 1, further comprising an on/off switch.

7. The personal cooling device of claim 1, wherein said delivery tube is fitted into headgear.

* * * * *